US009923304B2

(12) United States Patent
Eckel

(10) Patent No.: US 9,923,304 B2
(45) Date of Patent: Mar. 20, 2018

(54) CONTACT PREVENTER FOR AN ELECTRICAL CONDUCTOR AND ASSEMBLY FOR CONNECTING TWO ELECTRICAL CONDUCTORS

(71) Applicant: TE Connectivity Germany GmbH, Bensheim (DE)

(72) Inventor: Markus Eckel, Buerstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/995,330

(22) Filed: Jan. 14, 2016

(65) Prior Publication Data

US 2016/0204548 A1 Jul. 14, 2016

(30) Foreign Application Priority Data

Jan. 14, 2015 (DE) ..... 10 2015 200 496

(51) Int. Cl.

| | |
|---|---|
| ***H01R 11/22*** | (2006.01) |
| ***H01R 13/11*** | (2006.01) |
| ***H01R 13/629*** | (2006.01) |
| ***H01R 13/44*** | (2006.01) |
| *H01R 4/44* | (2006.01) |
| *H01R 11/12* | (2006.01) |
| *H01R 13/707* | (2006.01) |

(52) U.S. Cl.

CPC ..... *H01R 13/62911* (2013.01); *H01R 13/44* (2013.01); *H01R 4/44* (2013.01); *H01R 11/12* (2013.01); *H01R 13/707* (2013.01)

(58) Field of Classification Search

CPC ..... H01R 13/11; H01R 23/02; H01R 24/62; H01R 24/60; H01R 13/64

USPC ..... 439/857, 660, 674, 677, 680, 948

See application file for complete search history.

(56) References Cited

U.S. PATENT DOCUMENTS

| | | | | |
|---|---|---|---|---|
| 5,879,198 | A * | 3/1999 | Sekimori | H01R 13/44 439/289 |
| 6,027,360 | A * | 2/2000 | Jenkins | H01R 13/6215 439/248 |
| 7,037,142 | B2 * | 5/2006 | Evans | H01R 13/44 439/633 |
| 8,182,296 | B2 * | 5/2012 | De Blieck | H01R 43/16 439/378 |
| 8,696,390 | B2 * | 4/2014 | Tai | H01R 13/115 439/660 |

(Continued)

FOREIGN PATENT DOCUMENTS

| | | | | |
|---|---|---|---|---|
| EP | 0081937 | A2 * | 6/1983 | H01R 13/56 |
| EP | 1058348 | A1 | 12/2000 | |
| EP | 2642607 | A1 | 9/2013 | |

OTHER PUBLICATIONS

European Search Report, dated Jun. 7, 2016, 10 pages.
Abstract of EP1058348, dated Dec. 6, 2000, 1 page.

*Primary Examiner* — Abdullah Riyami
*Assistant Examiner* — Thang Nguyen
(74) *Attorney, Agent, or Firm* — Barley Snyder

(57) ABSTRACT

A contact stopper is provided and includes a conductor receiving receptacle and a protective housing. The protective housing includes a body and a fork-shaped mating section positioned opposite the conductor receiving receptacle. The fork-shaped mating section includes a pair of contact slots that run parallel to a length thereof and extends into an interior of the body.

19 Claims, 11 Drawing Sheets

(56) References Cited

U.S. PATENT DOCUMENTS

| | | | | |
|---|---|---|---|---|
| 9,004,954 | B2 * | 4/2015 | Baldwin | H01R 13/46 439/680 |
| 9,136,652 | B2 * | 9/2015 | Ngo | H01R 24/00 |
| 2004/0142605 | A1 * | 7/2004 | Harada | H01R 4/185 439/857 |
| 2005/0118892 | A1 * | 6/2005 | Shindo | H01R 13/05 439/857 |
| 2013/0252474 | A1 * | 9/2013 | Baldwin | H01R 13/46 439/660 |

* cited by examiner

CONTACT PREVENTER FOR AN ELECTRICAL CONDUCTOR AND ASSEMBLY FOR CONNECTING TWO ELECTRICAL CONDUCTORS

CROSS-REFERENCE TO RELATED APPLICATIONS

This application claims the benefit of the filing date under 35 U.S.C. § 119 (a)-(d) of German Patent Application No. 102015200496.1, filed Jan. 14, 2015.

FIELD OF THE INVENTION

The invention relates to a connector assembly and, more particularly, to a connector assembly having a contact stopper.

BACKGROUND

There are known assemblies for connecting electrical conductors. Often, two conductors are connected to one another by simply plugging them together. However, in the areas of high voltages and/or strengths of currents, plug type connections are frequently impractical considering solid conductors are frequently used, with which plug connectors are incomplete. Typically, screw connections are used to connect at least one current rail or one cable shoe to another conductor. For example, a cable shoe with a fastener receiving space for a screw can be screwed onto a current rail or a second cable shoe. In this case, either a screw protrudes through a hole into the cable shoe and is screwed with an insert nut in the current rail, or the screw protrudes through both parts and is equipped with a nut so that the current rail and the cable shoe are clamped between the screw head and the nut.

Similar connections are used if two current rails or two cable shoes are intended to be connected to one another. This connection method is time-consuming and has several disadvantages. For example, the screw and/or the nut can be lost when connecting or releasing the conductors. A further known problem can be that a screw cannot be completely unscrewed from both conductors. In this case, it can be that, if the screw has arrived at the end of a maximum path, it fully penetrates one of the two conductors and at the same time is still partly arranged in the other conductor. The releasing of the two conductors from one another is consequently hindered or even impossible. A further known disadvantage is that at least one of the two conductors is frequently only insufficiently or not at all protected from touching and therefore can endanger the safety of a person handling at least one of the conductors.

SUMMARY

A contact stopper is provided and includes a conductor receiving receptacle and a protective housing. The protective housing includes a body and a fork-shaped mating section positioned opposite the conductor receiving receptacle. The fork-shaped mating section includes a pair of contact slots that run parallel to a length thereof and extends into an interior of the body.

BRIEF DESCRIPTION OF THE DRAWINGS

In the drawings, the same reference numerals are always used for elements with the same function and/or the same structure.

DETAILED DESCRIPTION OF THE EMBODIMENT(S)

Figure 2:
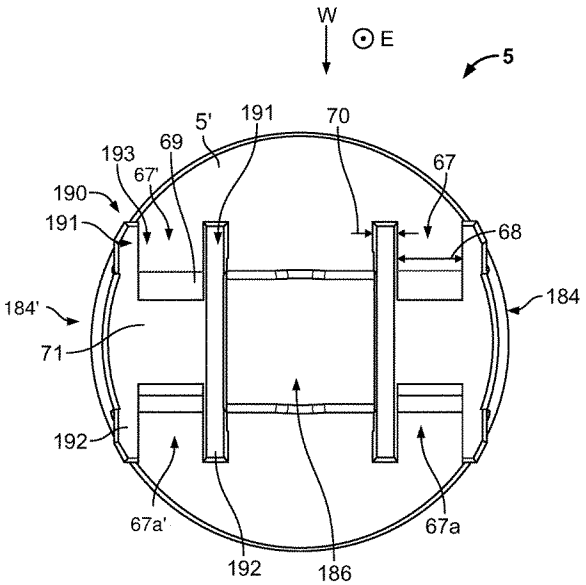
FIG. 2 is a top view of the contact stopper from FIG. 1.
Figure 1:
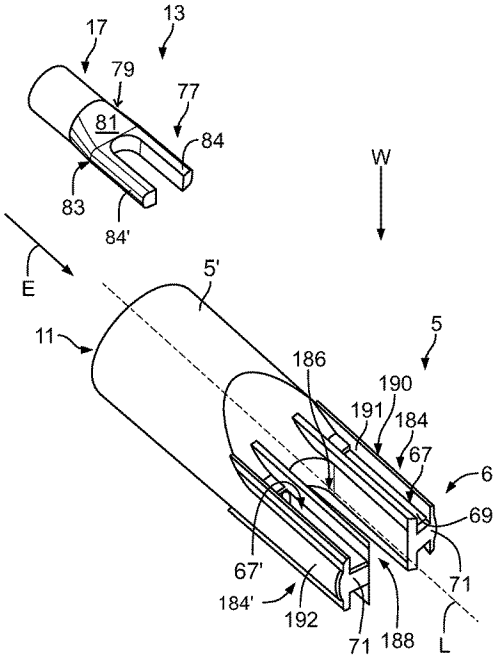
FIG. 1 is a perspective view of a contact stopper according to the invention.

First with reference to FIGS. 1 and 2, a contact stopper according to the invention is shown.

As shown, the contact stopper 5 includes a protective housing 5' with a receptacle 11 at its end pointing in the opposite direction to insertion direction E. An electrical conductor 13 can be introduced through the receptacle 11, with its end section 77 leading the way, into the protective housing 5' of the contact stopper 5. The end section 77 of this conductor (hereafter referred to as the second conductor 13) is also schematically depicted in FIG. 1.

The end section 77 of the conductor 13 substantially consists of a flat body 79 with an upper flat side 81 and a lower flat side 83. In the shown embodiment, the end section 77 is fork shaped member having two mating prongs 84, 84', which point in the insertion direction E and can be arranged in a corresponding fork-shaped mating section 6 of the protective housing 5' such that the mating prongs 84, 84' correspond to a contact slot 67, 67'. An interior 69 of the contact stopper 5 is exposed to contact the mating prongs 84, 84', of the contact stopper 5.

The contact stopper 5 includes a protective housing 5' which has a fork-shaped mating section 6 with at least one contact slot and in the exemplary embodiment shown two contact slots 67, 67', which run(s) parallel to insertion direction E and outwardly expose(s) an interior 69 of the contact stopper 5.

The contact slots 67, 67' and accordingly the contact stopper 5 are closed at the front end 71 pointing in insertion direction E, which increases safety because the end region 77 of the conductor 13 received in the contact stopper 5 cannot be touched by the user's fingers in insertion direction E.

In the embodiment shown, the fork-shaped mating section 6 has two mating prongs 184, 184'. The mating prongs 184, 184' provide a recess 186 situated between them. The recess includes an opening 188 at one end thereof. The recess 186 extends from its opening 188 in the opposite direction to insertion direction E. In the embodiment shown, the recess 186 runs between the two contact slots 67, 67'. In the embodiment shown, the opening 188 extends away from the receptacle 11.

In the embodiment shown, the two contact slots 67, 67' form a guide 190 for inserting the contact stopper 5, which will be explored in greater detail below.

In the embodiment shown, the contact stopper 5 includes two contact slots 67, 67' which run parallel to insertion direction E. The contact slot 67 exposes the interior 69 of the contact stopper 5. The contact slot 67 extends up to a front end 71 of the contact stopper 5. The contact slot 67 has a slot width 68 transverse to insertion direction E. In an exemplary embodiment, a wall thickness 70 of the contact stopper 5, along the contact slot 67. The ratio of slot width 68 to wall thickness 70 is approximately 1.75 in the shown embodiment. The contact slot 67, 67' or the contact stopper 5 is closed along the front end 71 thereof.

The contact stopper 5 further includes two secondary contact slots 67*a*, 67*a'* on opposite sides of the contact slots 67, 67'. In plug-in direction E and effective direction W, the secondary contact slots 67*a*, 67*a'* are configured similarly to the contact slots 67, 67'.

As already mentioned, the end section 77 of the second conductor 13 is provided by the flat body 79 of the cable shoe 17. The flat body 79 includes an upper flat side 81 and a lower flat side 83. The lower flat side 83 is exposed by the secondary contact slots 67*a*, 67*a'* for contacting with the first conductor 9, and the upper flat side 81 is exposed by the contact slots 67, 67'. The flat sides 81 and 83 run perpendicular to the effective direction W when the second conductor 13 is received with the contact stopper 5 on the fastener 3.

Figure 3:
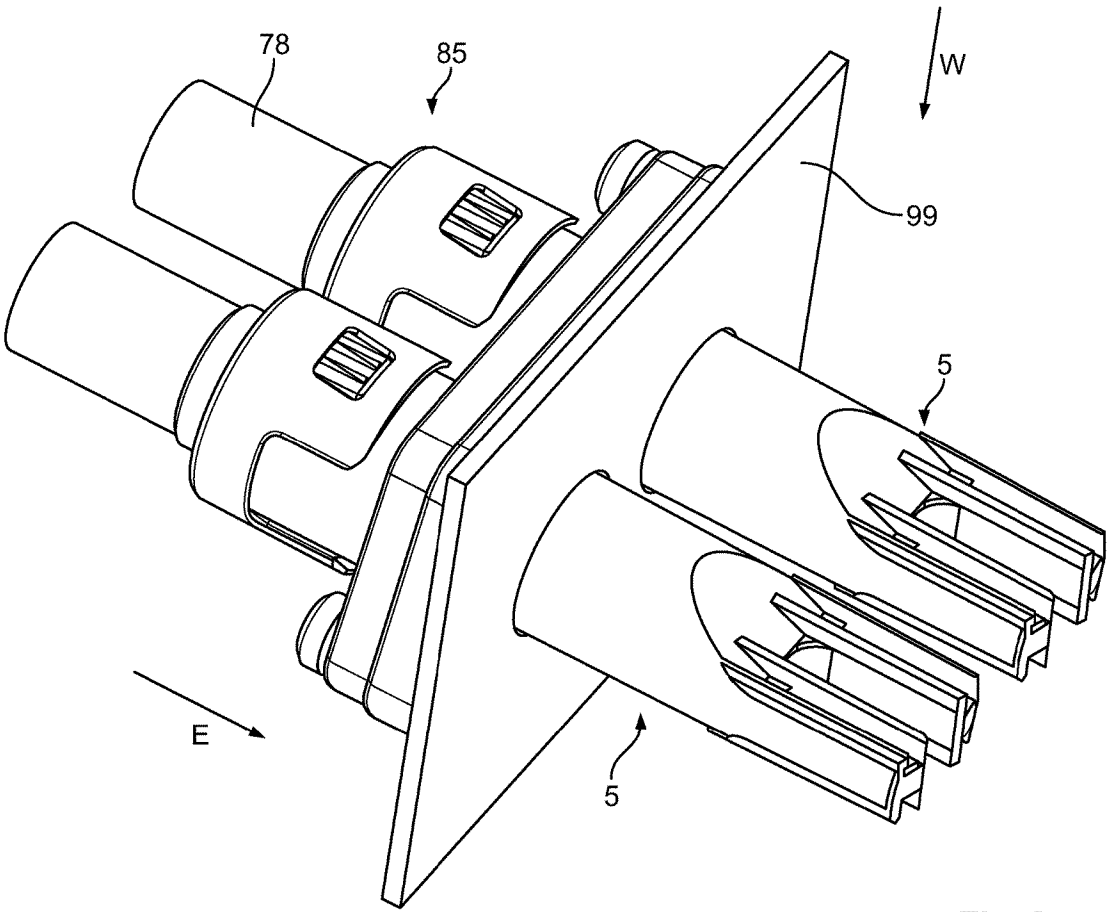
FIG. 3 is another perspective view of a connector assembly according to the invention.

As shown in FIG. 3, the contact stopper 5 according to the invention includes a conductor 13 (not visible in FIG. 3) received therein. In the embodiment shown, two such identical conductors 13 with the contact stoppers 5 are flange-mounted side-by-side on a housing wall 99. In this case, in the embodiment shown, the flat body 79 is a cable shoe 17 that is crimped together by an end section 77 (i.e. fork-shaped) in a crimped region 85 with the end of the contact stopper 5, which points in the opposite direction to insertion direction E. The contact stopper 5, the crimped region 85, and a cable insulator 78 protect the conductor 13 from exposure.

Now with reference to FIGS. 4 to 10, a connector assembly according to the invention will be described.

As shown, the connector assembly 1 includes a fastener 3 with at least one securing element 29 and a contact stopper 5. The fastener 3 includes a receptacle 7 for a first conductor 9 and the contact stopper 5 includes a receptacle 11 for a second conductor 13. Merely by way of example, the first conductor 9 is depicted as a current rail 15 and the second conductor 13 is depicted as a cable shoe 17. Alternatively, as one skilled in the art should appreciate, it is possible for the first conductor 9 to be formed by a cable shoe 17 and for the second conductor 13 to be formed by a current rail 15. It is also possible for both conductors 9 and 13 to be formed by current rails 15 or cable shoes 17.

In the shown embodiment, at least the end section 87 of the first conductor 9 is formed by a current rail 15. The end section 87 of the first conductor 9 is a flat body 89 with an upper flat side 91 and a lower flat side 92. The flat sides 91, 92 of the first conductor 9 can be situated parallel to the flat sides 81 and 83 of the second conductor 13, if both conductors 9, 13 are arranged in the fastener 3.

The end section 87 includes a fork head 98 having a notch 119 which runs from the front face, opposite to the plug-in direction E, and can be configured with two mating prongs 120, 121. One contacting member 97 each is positioned on each of the mating prongs 120, 121. As in the embodiment shown, the contacting member 97 can be arranged on the upper flat side 91. In the embodiment shown, the contacting members 97 include contacting ribs 97*a* which can be formed monolithically and provided as legs 101 of a substantially U-shaped profile in the end section 87. The legs 101 extend upward from the upper flat side 99 and substantially along the insertion direction E. However, the contacting members 97 do not have to be configured monolithically with the end section 87, as shown, but could also be provided as separate elements which then have to be placed at the suitable point in the assembly.

For this purpose, the securing element 29 is configured to connect the first conductor 9 to the second conductor 13 in a frictionally engaged manner. The securing element 29 can be formed as a screw 31. Turning the screw 31 about the screw longitudinal axis L leads to a movement of the screw 31 along, or in the opposite direction to, the effective direction W. The screw 31 has, as an actuation section 41, a screw head 35 which points in the opposite direction to effective direction W. The screw head 35 includes a screw head diameter 37 which is larger than a screw diameter 39. As a result, the screw 31 cannot be fully sunken. The screw head 35 provides an actuation section 41 of the securing element 29. The actuation section 41 does not necessarily have to be formed as a screw head 35. If the screw 31 is designed as a set screw, for example, the actuation section 41 can be formed at the end of the screw 31 pointing in the opposite direction to effective direction W, without going beyond the screw diameter 39. The actuation section 41 can be formed as a hexagonal socket fastener receiving space, for example. The securing element 29 can exert a force at least in effective direction W, in order to connect the first conductor 9 to the second conductor 13 in a frictionally engaged manner.

The fastener 3 can have two securing elements 29, 129. The second securing element 129 can be formed as a nut 131. The nut 131, as a second securing element 129, can be spaced apart from the first securing element 29, the screw 31, in effective direction W and can be screwed onto the screw 31 with a positive fit. In this manner, the first securing element 29 and the second securing element 129 can be connected to one another such that the operation of the one securing element, the screw 31, also simultaneously brings about an operation of the other securing element 129, the nut 131. This connection is distinguished by the fact that the screw head 35 and the nut 131 move towards one another in opposite directions to effective direction W and the expansion of the receptacle 7 is decreased as a result.

The fastener can form a receptacle 7 for the electrical conductors 9, 13. The receptacle 7 extends away in effective direction W of the securing element 29. The receptacle 7 can extend from the first securing element 29 to the second securing element 129.

In order to arrange the securing elements 29, 129 and/or a force distribution member 55 non-detachably on the fastener 3, stoppers 51, 151 can be provided. In the embodiment shown, the stoppers 51, 151 are configured as securing rings 52, 152 which are attached to a defined point of the screw 31, the securing ring 152 being situated in effective direction W behind the nut 131, thus preventing removal of the nut 33 from the screw 31. The securing ring 52 serves to retain a force distribution member 55, described in greater detail below, non-detachably on the screw 31.

The fastener 3 can further includes a movable force distribution member 55, on which the securing element 29 can exert a force. The force distribution member 55 can distribute a normal force generated by the securing element 29 in effective direction W, which is perpendicular to insertion direction E, onto a conductor 9, 13 that is arranged in the receptacle 7. The lower ends 57 of the force distribution member 55 are bent downwards in effective direction W and, in effective direction W, and align with a contact slot 67, 67' or directed towards said contact slot 67, 67'. The force distribution member 55 is configured in the shown embodiment as a bracket.

To electrically isolate the securing element 29 outside of the fastener 3, the securing element 29 has the electrically isolated actuation section 43 which is preferably formed by an isolating cap 45. The isolating cap 45 can have the shape of a screw head in order to be operated by a suitably configured tool. The isolating cap 45 is preferably formed from a plastic.

The connector assembly 1 includes a housing 47 independent from the fastener 3. The housing 47 includes a fastener receiving space 49 through which the electrically isolated actuation section 43 of the securing element 29 can protrude outwardly. The fastener receiving space 49 can be smaller than a stopper (not shown) of the electrically isolated actuation section 43. The contact stopper 5 can be formed as a circumferential ring or as a screw head and form a stop for the electrically isolated actuation section 43 in the opposite direction to effective direction W. The stopper therefore prevents the fastener 8 from being completely released from the fastener 3.

In addition, the housing 47 includes (as can clearly be seen in FIG. 4) a collar 53 which projects in a direction opposite to insertion direction E and exposes the inner section 48 of the housing 47 and, in particular, the receptacle 7 of the fastener 3 for the contact stopper 5. The collar 53 can prevent a finger, a tool or another part from getting into the housing 47 and can produce an electrical contact with one of the elements situated in the housing 47.

Figure 4:
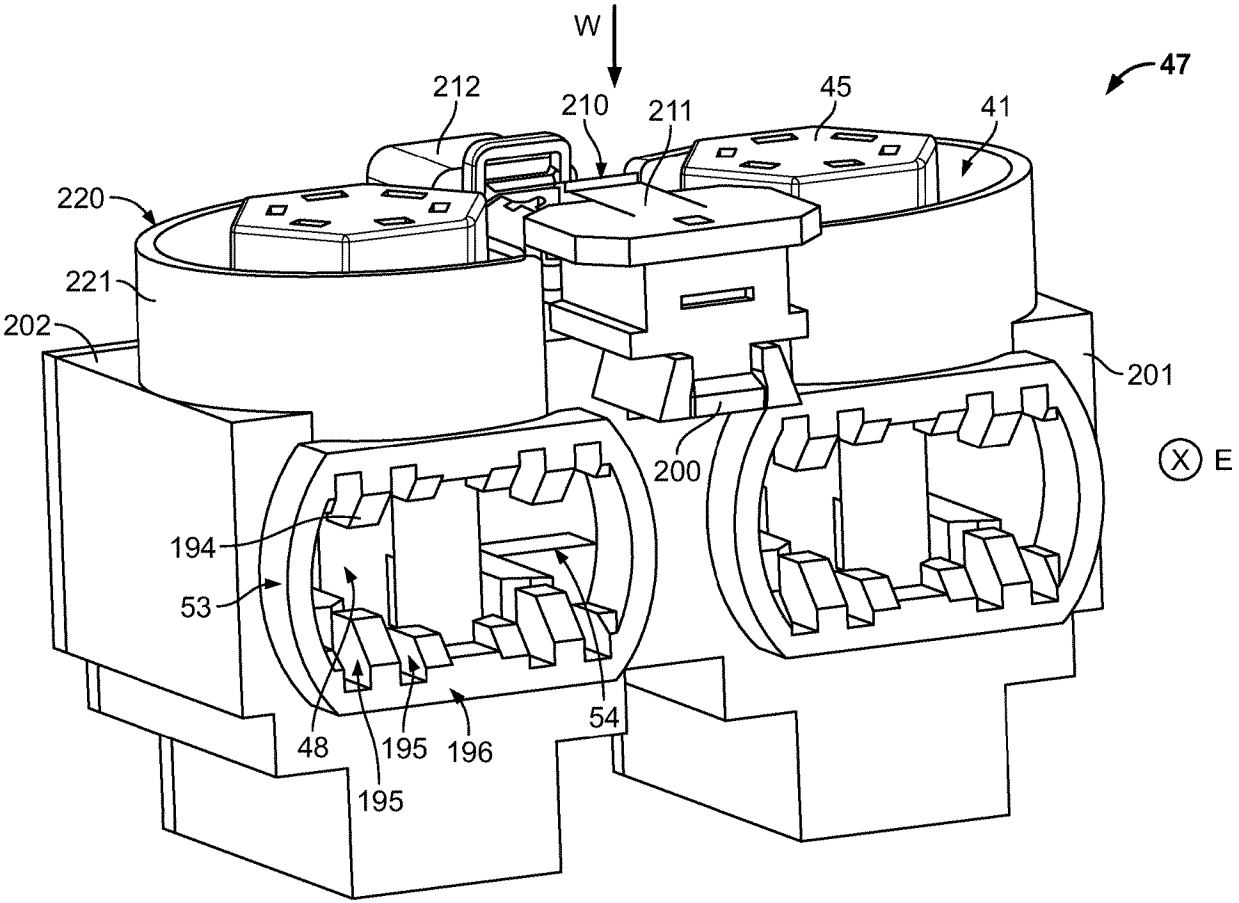
FIG. 4 is a perspective view of a housing of the assembly of FIG. 3.
Figure 5:
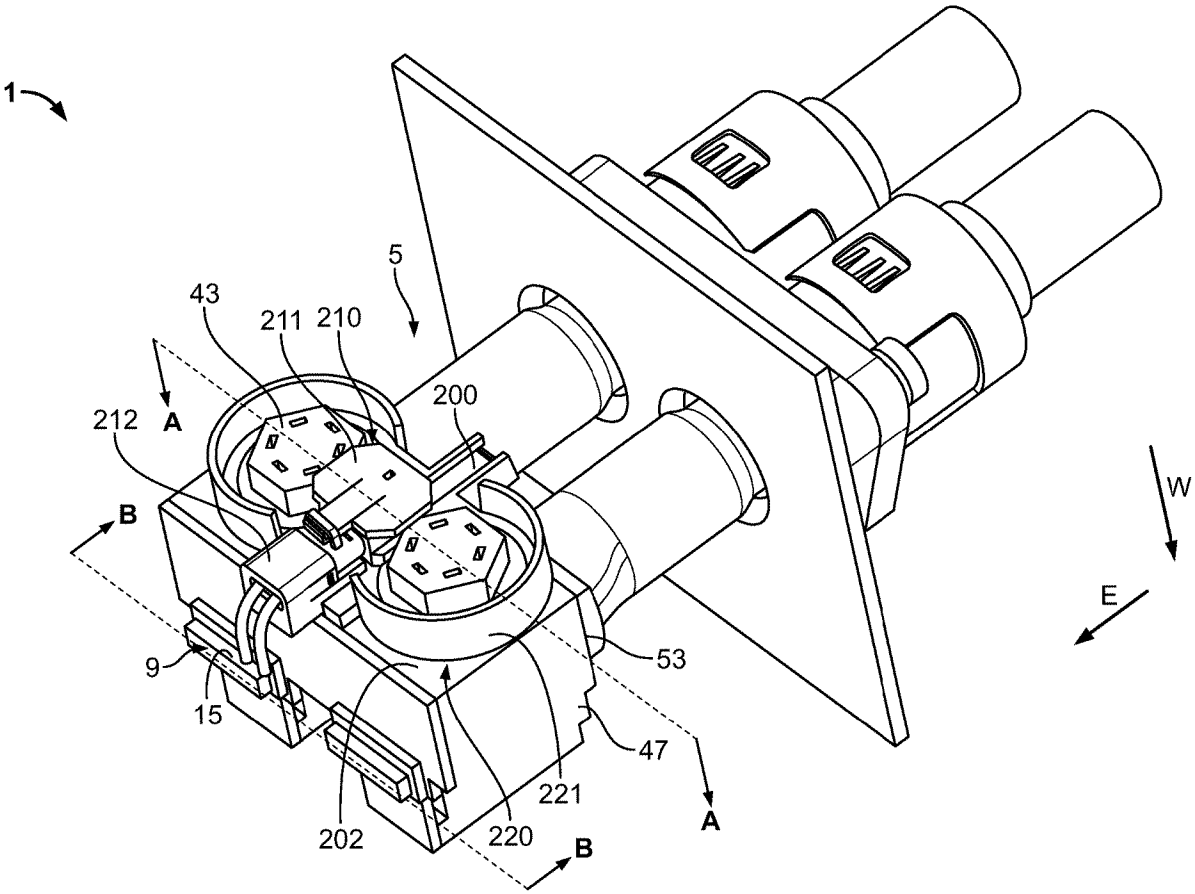
FIG. 5 is another perspective view of connector assembly according to the invention.
Figures 6, 7:
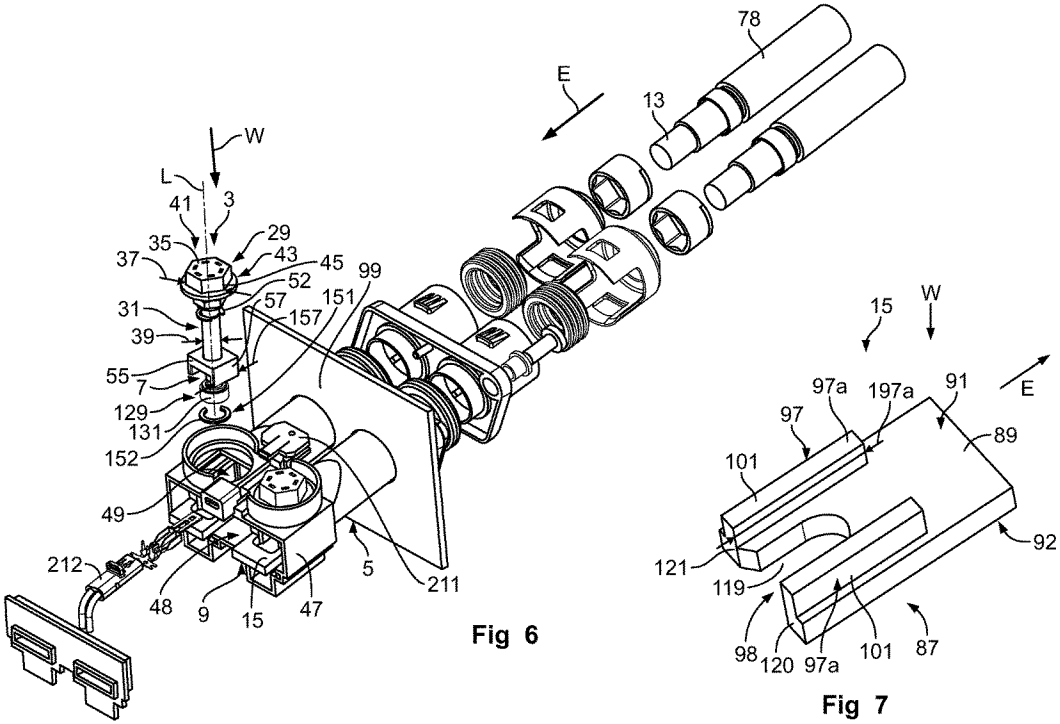
FIG. 6 is an exploded view of the connector assembly of FIG. 5.
FIG. 7 is an enlarged view a first electrical conductor of the connector assembly according to the invention.

Details of the housing 47 of the embodiment shown are explored in greater detail below with reference to FIG. 4 amongst others. In particular, the guided insertion of the contact stopper 5 into the inner section 48 of the housing 47 through the collar fastener receiving space 54 is explained in greater detail below.

When the contact stopper 5 is received in the interior 54, the contact slot 67, 67' exposes the interior 69 of the contact stopper 5 for the first conductor 9. In doing so, the securing element 29 is arranged above or below the contact slot 67. In the cross-section transverse to insertion direction (FIG. 8), the longitudinal axis L of the securing element 29, which axis runs parallel to effective direction W, is arranged centrally above the contact slot 67. The longitudinal axis L runs perpendicular to insertion direction E.

As described above, a contact slot 67, 67' provides a guide 190 for the straight-lined insertion of the contact stopper 5 along insertion direction E. In the embodiment shown, the contact slot 67 or 67' is provided with guide rails (or also protection members) 191. The guide rails 191 are configured by the lateral walls 192, which limit the contact slot 67, 67' transverse to insertion direction E and transverse to effective direction W. These lateral walls 192 and thus the guide rails 191 run in insertion direction E. A guide groove 193 is formed between the guide rails 191 of a contact slot 67, 67'. The collar 53 of the housing 47 includes counter guides 196 or, in the shown exemplary embodiment, with counter guide rails 194, between which a counter guide groove 195 is configured, which correspond to the guide rails 191 or the guide groove 193 of the contact stopper 5. When the contact stopper 5 is inserted in insertion direction E through the collar fastener receiving space 54, a counter guide rail 194 engages in a guide groove 193, and in a similar manner a guide rail 191 engages in the guide grooves 195. In this manner, a directed insertion of the contact stopper 5 into the housing 47 is facilitated.

The housing 47 can further have a protection member 200 which protrudes from the wall 201 of the housing 47 in the region of the actuation section 41. The protection member 200 can prevent fingers etc. from getting caught in the region of the securing element 29 when actuating the securing element 29.

Figure 10:
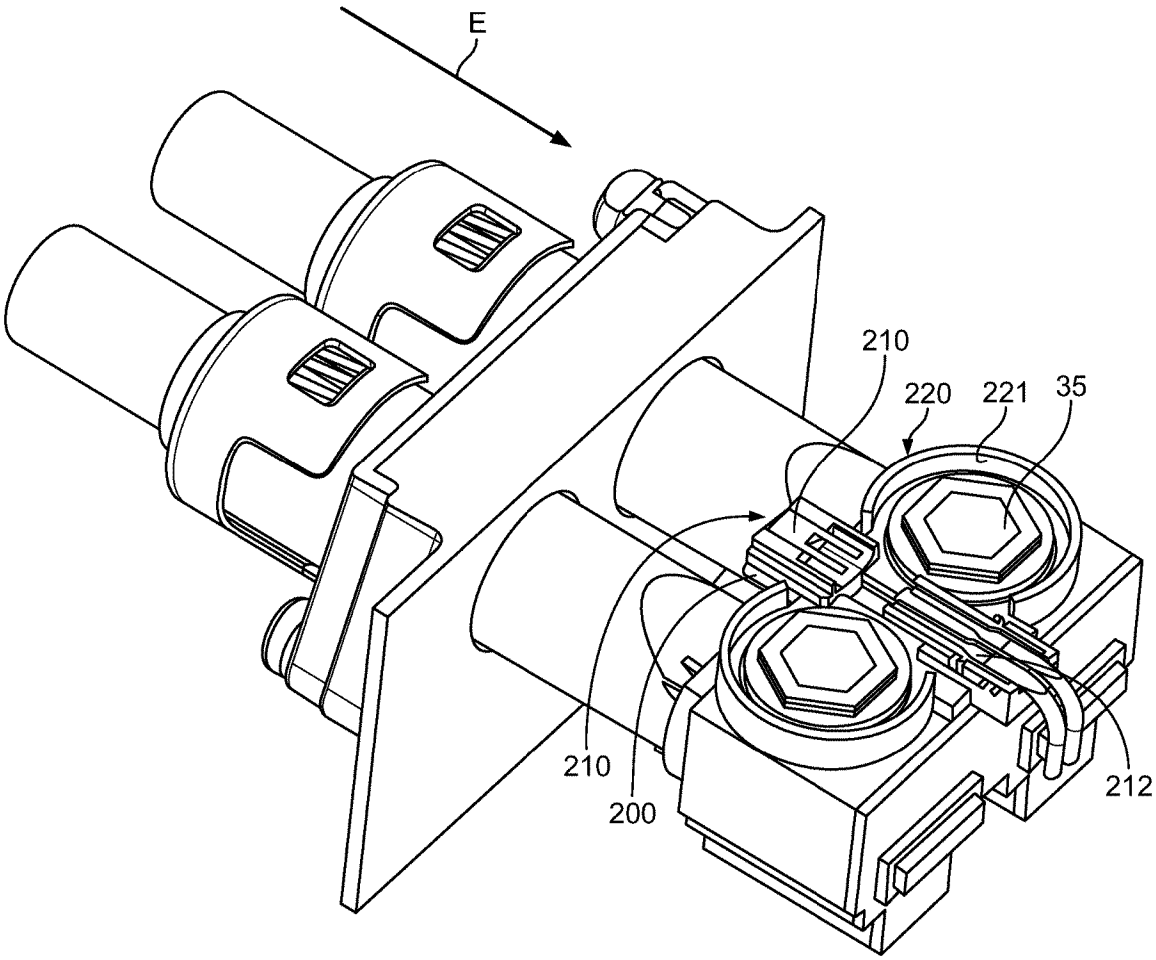
FIG. 10 is another perspective view of the connector assembly of FIG. 5.

The connector assembly 1 can further include an actuation safeguard 210 which can be transferred from a closed position (see FIG. 5) into an open position (see FIG. 10). In the closed position, the actuation safeguard 210 prohibits operation of the securing element 29, whereas the actuation safeguard 210 in the open position exposes the operation of the securing element 29. In the embodiment shown, the actuation safeguard 210 is movable relative to the securing element 29. The actuation safeguard 210 is removably positioned on the side 202 of the housing 47 pointing in the opposite direction to effective direction W and can be moved in, or in the opposite direction to, insertion direction E. In the open position (see FIG. 10), the actuation safeguard 210 is situated above the protection member 200, which can assume two functions: (1) a finger protection function, and (2) a guide and receptacle for the actuation safeguard 210 in its open and closed positions respectively.

In the shown embodiment, the actuation safeguard 210 includes an interlock member 211 and a counter-member 212, which form an interlock system.

In the closed position, the actuation safeguard 210, the interlock member 211 in the embodiment shown, is arranged such that the actuation section 41 of the securing element 29 is not accessible. For this purpose, the interlock member 211 can be situated so close to the screw head 35 or its isolating cap 45 that it becomes impossible to grip, not to mention turn, the screw head with a tool, for example a socket wrench. In the open position, the actuation safeguard 210 then moves so far away from the securing element 29 that it can be operated, i.e. the screw 31 can be turned.

The connector assembly 1 according to the invention can further have an actuator opening 220 which indicates the direction from which the actuation section 41 is accessible. In the exemplary embodiment shown, the actuation section 41 is bordered on the side of the housing 47 which points in the opposite direction to effective direction W. For this purpose, a collar 221 is provided and rises from the side 202 of the housing 47 pointing in the opposite direction to effective direction W. The collar 221 encloses large parts of the actuation section 41, i.e. the screw head 35 or its isolated actuation section 43. The collar 221 can enclose at least half, and in the embodiment shown almost two-thirds, of the actuation section 21. In the embodiment shown, the collar 221 is only open at the point at which the interlock system is located with the interlock member 211 and its counter-member 212. However, configurations would be conceivable in which the collar 221 completely encloses the actuation section 41. The collar 221 ensures that the actuation section 41 cannot be reached laterally, i.e. transverse to effective direction W. As a result, no open-end wrench, for example, can be applied to the screw head 35. When the actuation safeguard 210 is in the open position, a socket wrench can only be placed onto the screw head 35 or its isolating cap 45 in effective direction W, in order to actuate the securing element 29.

To connect the conductors 9 and 13, the first conductor 9 is arranged in the inner section 48 of the housing 47 so that the screw 31 penetrates the notch 119 in effective direction W. In insertion direction E, the contact stopper 5 is positioned; with its plugging area leading the way through the collar fastener receiving spaces 54, in the inner section 48 until the screw 31 also penetrates the recess 186 of the contact stopper. In the embodiment shown, the first conductor 9 is thereby arranged in effective direction W beneath the second conductor 13.

Before the two conductors 9 and 13 are connected, the securing element 29 is operated such that at least one of the two conductors 9 and 13 or both can be smoothly inserted into the receptacle 7. Only after both the first conductor 9 and the second conductor 13 with the contact stopper 5 in the receptacle 7 are arranged on the fastener 3, the securing element 29 operated, so that a normal force is exerted along the effective direction W on both conductors 9 and 13. The securing element 29 is therefore operated separately.

If the securing element 29 is operated by the screw head 35 being rotated about the longitudinal axis L of the screw 31, the screw 31 moves in effective direction W. At the same time, the nut moves in the opposite direction to effective direction W. As a result, the spatial expansion of the receptacle 7 in effective direction W is reduced and the first conductor 9 situated in the receptacle 11 can be pressed onto the second conductor 13 situated in the receptacle 7 and, as a result, the two conductors are connected to one another in a frictionally engaged manner and are electrically connected.

Figure 8:
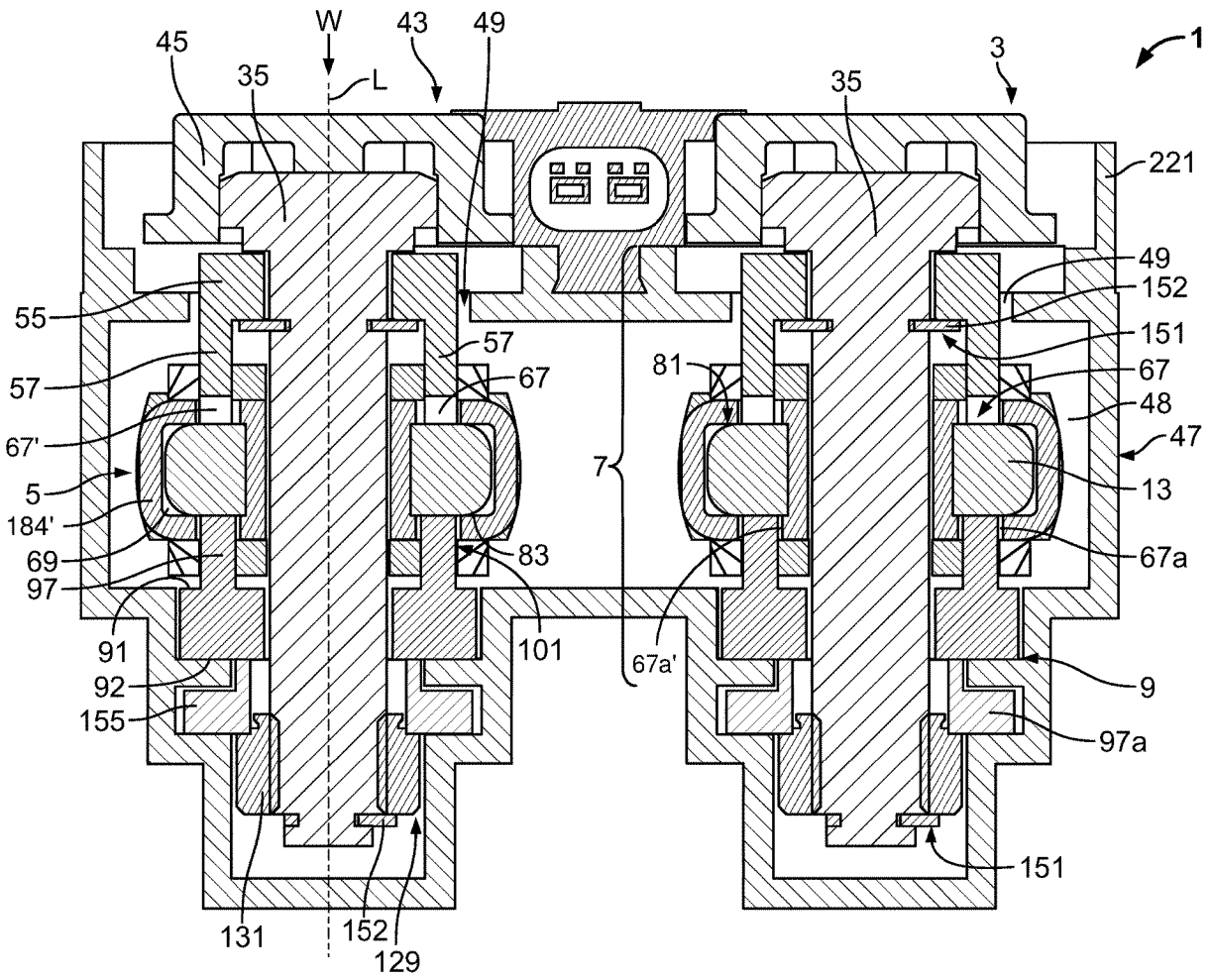
FIG. 8 is a cross-section view of the connector assembly according to the invention taken along line A-A of FIG. 5.
Figure 9:
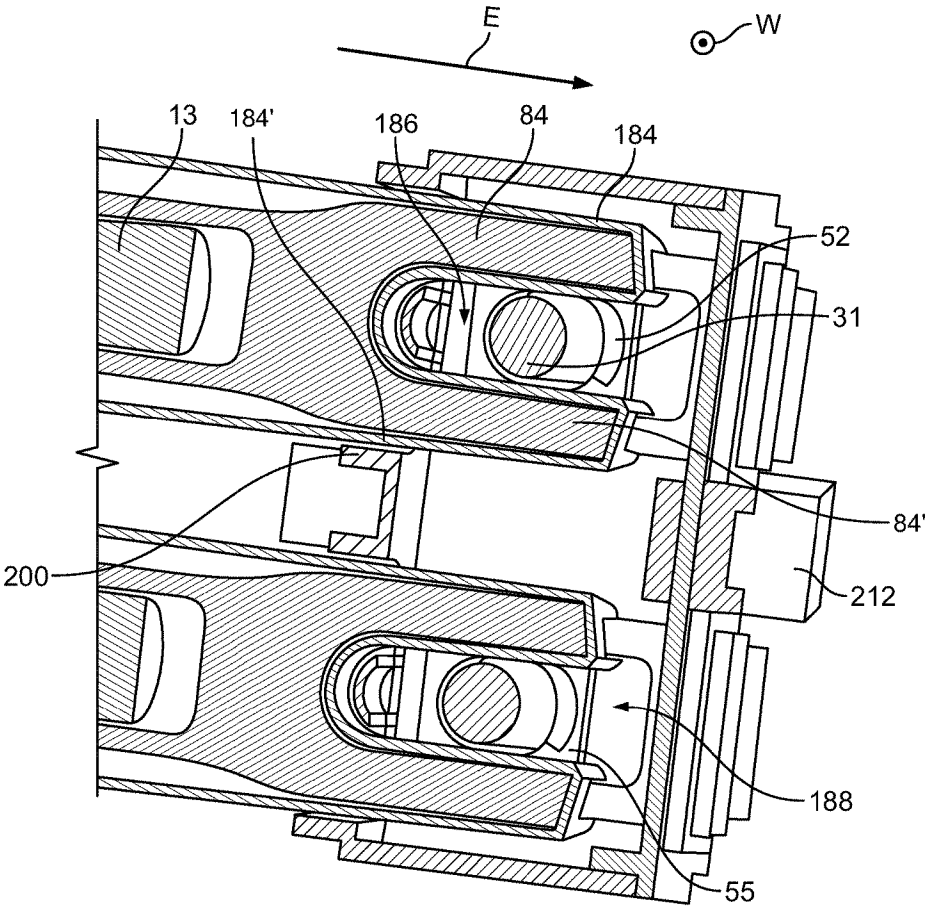
FIG. 9 is a cross-section view of the connector assembly according to the invention taken along line B-B of FIG. 5.

As shown FIG. 8, the first conductor 9 and the second conductor 13 are arranged in the receptacle 7 of the fastener 3. Upon operation, the screw head 35 moves downwards in effective direction W and, in the process, presses on the force distribution member 55 which passes the pressing force into its downwardly bent lower ends 57. Since the lower ends 57 are arranged in effective direction W above the contact slots 67, 67', the lower ends 57 can penetrate into the interior 69 of the contact stopper 5 via the contact slots 67, 67' and press the mating prongs 84, 84' located in the mating prongs 184, 184' of the contact stopper 5 in the end section 77 of the second conductor 13 in effective direction W and, thus, in the direction of the second conductor 13.

At the same time, the second securing element 129 and the nut 131 move in the opposite direction to effective direction W and transmit a pressing force onto the lower flat side 92 in the end section 87 of the first conductor 9. Starting from there, forces are transmitted through the body of the end section 87 into the contacting members 97, namely the leg 101, which protrude out of the upper flat side 91 of the first conductor 9 in effective direction W. In this case, the contacting members 97/legs 101 align with the contact slots 67*a*, 67*a*' in effective direction W, and frictionally engage the mating prongs 84, 84' in the end section 77 of the second conductor 13. A second force distribution member 155 can be arranged between the second securing element 129 and the first conductor 9 to transmit force from the nut 131 to the first conductor 9, so that it is distributed uniformly and over a larger surface without unintentionally deforming this conductor 9 under the force exerted by the securing element 129.

Figure 11:
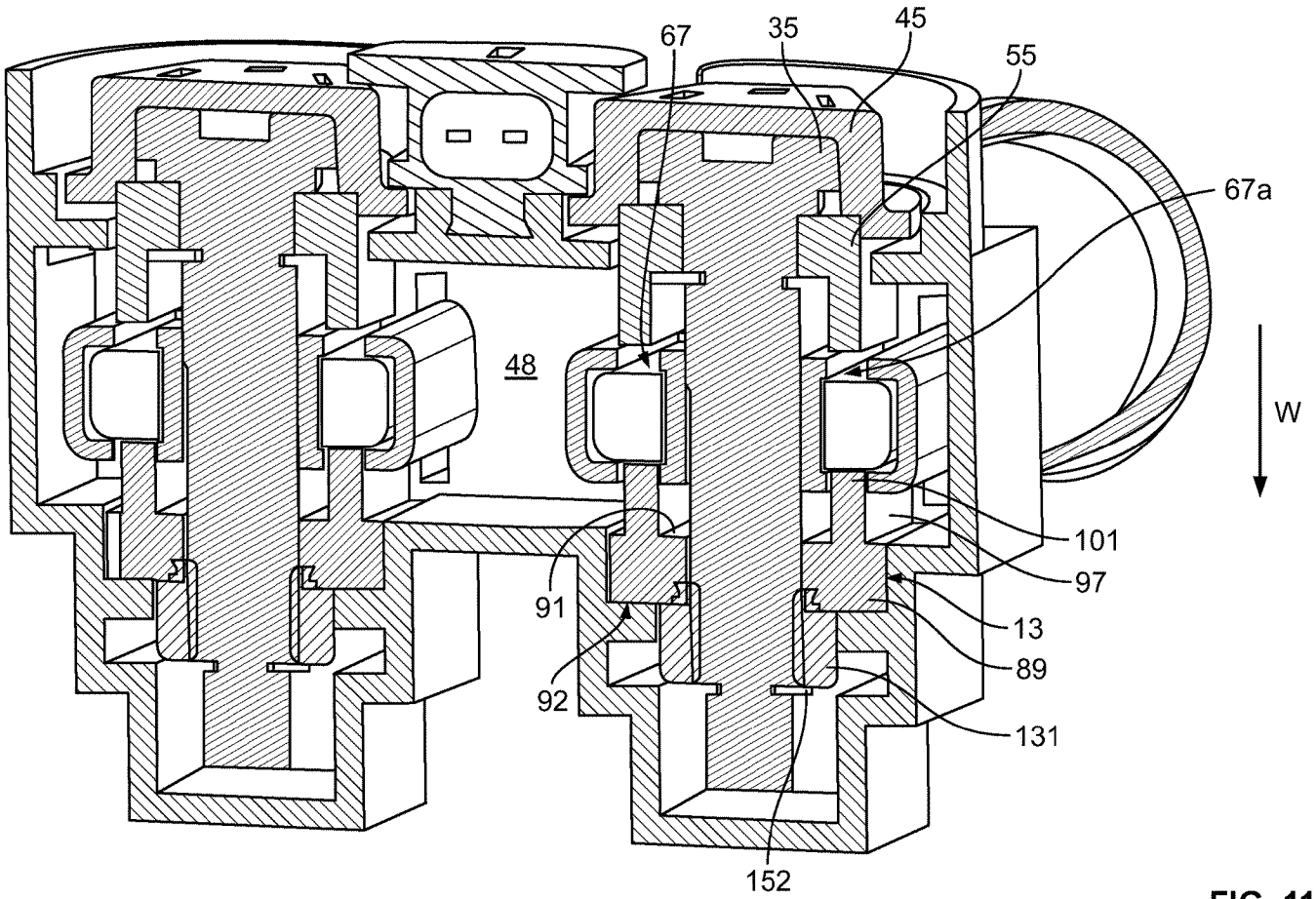
FIG. 11 is a cross-section view of another connector assembly according to the invention.

As can be seen in FIG. 11, this second force distribution member 155 can also be omitted and the nut 131 can be arranged, in a force-transmitting manner, directly on the conductor 9 allocated to it. The nut 131 is then pressed directly into the current rail 15, as is the case in the shown connector assembly 1.

Figure 13:
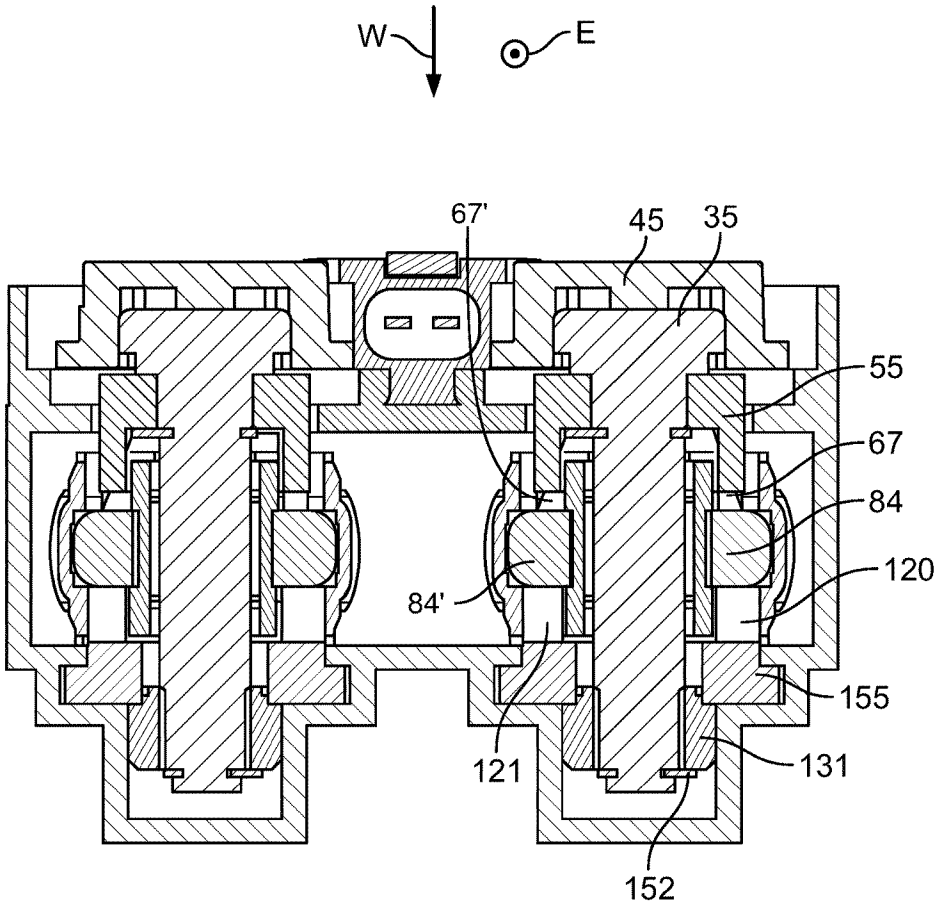
FIG. 13 is a cross-section view of another connector assembly according to the invention.
Figure 12:
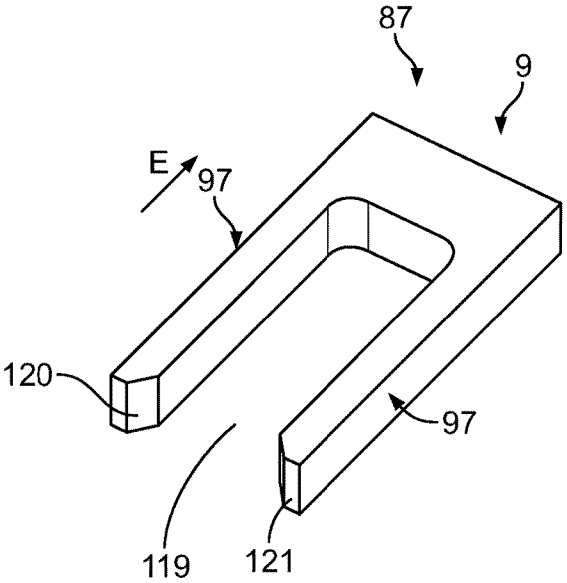
FIG. 12 is a perspective view of another first conductor according to the invention.

Now with reference to FIGS. 12 to 14, another connector assembly 1 will be described. As shown, the mating prongs 120, 121 in the end section 87 of the first conductor directly from the contacting members 97. Compared to the aforementioned embodiment, the legs 101 can be omitted in the shown embodiment. This facilitates the manufacture of the end section 87 of the first conductor, which can be constructed from a current rail 15 (from a cable shoe 17) having a notch that points in the opposite direction to plug-in direction E.

Figure 14:
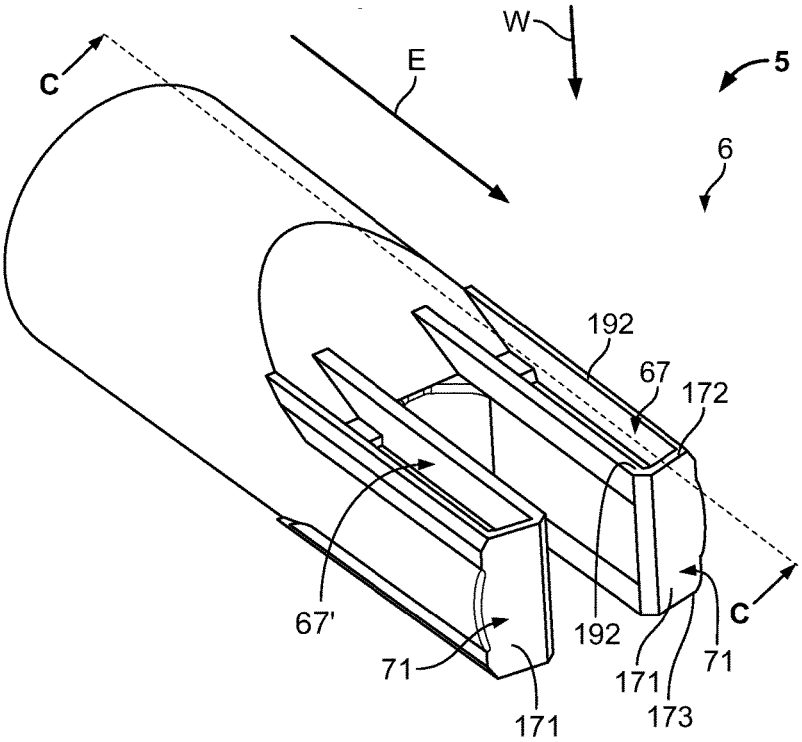
FIG. 14 is a perspective view of another a contact stopper according to the invention.
Figure 15:
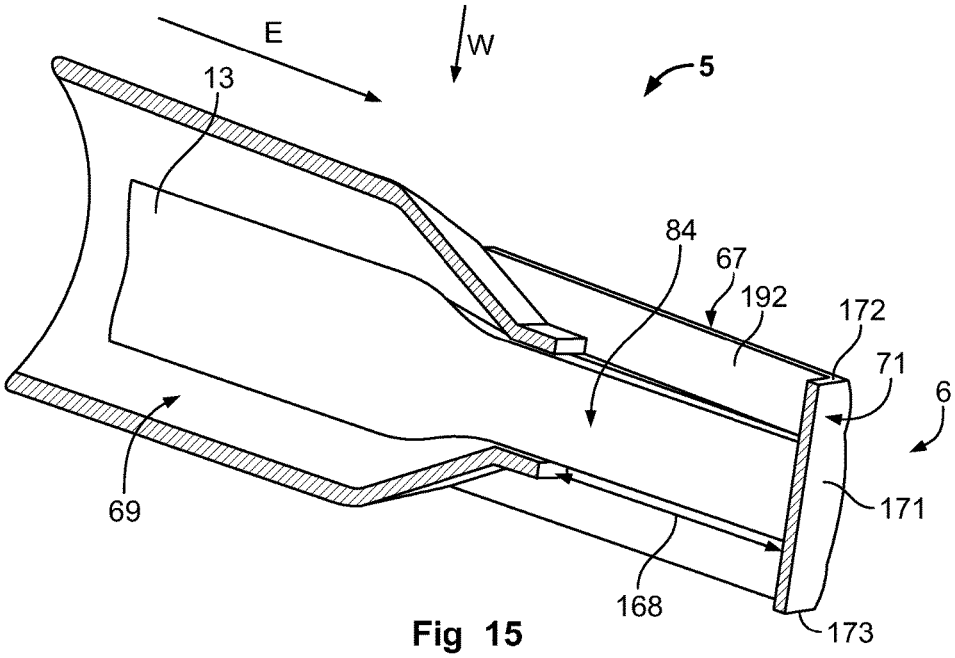
FIG. 15 is a sectional view of the contact stopper of FIG. 14 taken along line C-C.

The contact stopper 5 shown in FIGS. 14 and 15 corresponds largely to the contact stopper 5 described above, such that hereafter only the differences of the shown embodiment of the contact stopper 5 compared to those of the embodiment depicted in FIGS. 1 and 2 are cited. The contact slot 67, 67' is closed at the front end 71 pointing in insertion direction E. In the shown embodiment, the closure wall 171 at the front end 71 of the contact slot 67, 67' or contact stopper 5 is extended upwards or downwards in or in the opposite direction to effective direction W to such an extent that the closure wall 171, in the projection in the opposite direction to insertion direction E, completely obscures the contact slots 67, 67', etc. The upper rim 172 of the closure wall 171 aligns with the rim of the lateral wall 192 in the opposite direction to effective direction W. The lower rim 173 of the closure wall 171 likewise aligns with the lower rim of the lateral wall 192 in effective direction W. Overall, in the fork-shaped mating section 6 of the contact stopper 5, there is thus a plugging face which is completely closed in insertion direction E, i.e. it is not possible, in the opposite direction to insertion direction E, to penetrate into the interior 69 of the contact stopper 5. In other words, the contact slots are not accessible in the opposite direction to insertion direction E. This increases the safety of the contact stopper 5 according to the invention because it spatially limits the accessibility of the interior 69 of the contact stopper 5 via the contact slots 67, 67'. In the shown embodiment, access to the interior 69 via the contact slots 67, 67' is only possible in effective direction W.

An advantage of the contact stopper 5 of the shown embodiment is that the contacting of a conductor 13 received in the contact stopper 5 can then only take place if the contact stopper 5 has been completely introduced into the housing 47 in insertion direction E. If the contact stopper 5 is not yet fully introduced in insertion direction E, the closure wall 171 can block contact of the mating prongs 84, 84' of the second conductor 13 with the end section 87 of the first conductor. This blocking is be realized when the lower ends 57 of the force distribution member 55 or the contacting ribs 97*a* or legs 101 of the contacting member 97, viewed in effective direction W, overlap the upper rim 172 of the closure wall 171. If the fastener 8 is operated, the ends of the force distribution member 55 or the contacting ribs 97*a* would therefore rest on the upper rim 172 or lower rim 173 of the closure wall 171 and not retract into the contact slot 67, 67', 67*a*, 67*a*'.

For this purpose, the length 168 of the contact slot is of a size such that it substantially corresponds to the length of the lower ends 57 or the length of the contacting rib 197*a* or is only marginally shorter. However, other blocking means can also be provided for the connector assembly 1 that prohibits the fastener 3 from accessing the interior 69 of the contact stopper 5. For example, an access block could cover the contact slot, as long as the contact stopper 5 is not yet positioned properly for the contacting.

The foregoing illustrates some of the possibilities for practicing the invention. Many other embodiments are possible within the scope and spirit of the invention. The disclosed invention utilizes the above identified components, as a system, in order to more efficiently construct a connector assembly 1 for a particular purpose. Therefore, more or less of the aforementioned components can be used to conform to that particular purpose. It is, therefore, intended that the foregoing description be regarded as illustrative rather than limiting, and that the scope of the invention is given by the appended claims together with their full range of equivalents.

What is claimed is:

1. A contact stopper comprising:

a protective housing having a conductor receiving receptacle and a fork-shaped mating section positioned opposite the conductor receiving receptacle, the fork-shaped mating section includes a pair of contact slots substantially parallel to a length thereof and extending into an interior of the protective housing, a fork-shaped end section of a conductor disposed in the fork-shaped mating section and exposed through the contact slots to an exterior of the protective housing in a direction perpendicular to a longitudinal direction of the protective housing.

2. The contact stopper according to claim 1, wherein each contact slot includes a closed front end.

3. The contact stopper according to claim 2, wherein the fork-shaped mating section includes a pair of mating prongs and a recess positioned between the pair of mating prongs.

4. The contact stopper according to claim 3, wherein the recess is located between the pair of contact slots.

5. The contact stopper according to claim 4, wherein each contact slot is a contact stopper guide.

6. The contact stopper according to claim 5, further comprising a pair of secondary contact slots horizontally positioned opposite the pair of contact slots.

7. A connector assembly comprising:

a housing having a fastener receiving passageway and a stopper receiving passageway;

a fastener removably positioned in the fastener receiving passageway and having an actuatable securing element; and a contact stopper removably positioned in the stopper receiving passageway and having a conductor receiving receptacle positioned at one end thereof, the contact stopper including a protective housing having a fork-shaped mating section positioned opposite the conductor receiving receptacle, the fork-shaped mating section includes a pair of contact slots parallel to a length thereof and extending into an interior of the protective housing.

8. The connector assembly according to claim 7, wherein the contact slot includes a closed front end.

9. The connector assembly according to claim 8, wherein the fork-shaped mating section includes a pair of mating prongs and a recess positioned between the pair of mating prongs.

10. The connector assembly according to claim 9, wherein the recess extends between the pair of contact slots.

11. The connector assembly according to claim 10, wherein each of the pair of contact slots is a contact stopper guide.

12. The connector assembly according to claim 11, further comprising a pair of secondary contact slots horizontally positioned opposite the pair of contact slots.

13. The connector assembly according to claim 9, wherein the fastener includes a securing element and a movable force distribution member on which the securing element exerts a force.

14. The connector assembly according to claim 13, wherein the housing is electrically isolated from the fastener.

15. A contact stopper comprising:

a protective housing having a conductor receiving receptacle and a fork-shaped mating section positioned opposite the conductor receiving receptacle, the fork-shaped mating section includes a pair of contact slots substantially parallel to a length thereof and extending in an insertion direction of the contact stopper from the conductor receiving receptacle to a front end opposite the conductor receiving receptacle, the front end of each contact slot closed in the insertion direction.

16. The contact stopper according to claim 15, wherein the fork-shaped mating section includes a pair of mating prongs and a recess positioned between the pair of mating prongs.

17. The contact stopper according to claim 16, wherein the recess is located between the pair of contact slots.

18. The contact stopper according to claim 17, wherein each contact slot is a contact stopper guide.

19. The contact stopper according to claim 18, further comprising a pair of secondary contact slots horizontally positioned opposite the pair of contact slots.

* * * * *